United States Patent [19]

McKibben et al.

[11] Patent Number: 4,639,968

[45] Date of Patent: Feb. 3, 1987

[54] MACHINE FOR CLEANING CASTINGS

[75] Inventors: Kenneth D. McKibben, Defiance, Ohio; Alan P. Gould, Au Gres, Mich.; Craig J. Groh, Standish, Mich.; Thomas E. Wuepper, Alger, Mich.

[73] Assignee: Seaton SSK Engineering Inc., Au Gres, Mich.

[21] Appl. No.: 762,625

[22] Filed: Aug. 5, 1985

[51] Int. Cl.[4] ..... B08B 5/02

[52] U.S. Cl. ..... 15/304; 15/306 B; 15/316 R; 15/316 A

[58] Field of Search ..... 15/304, 316 R, 316 A, 15/306 B

[56] References Cited

U.S. PATENT DOCUMENTS

| | | | |
|---|---|---|---|
| 2,255,615 | 9/1941 | Frankel | 15/304 |
| 2,830,605 | 4/1958 | Kleeman et al. | 15/304 X |
| 3,159,164 | 12/1964 | McBrady | 15/304 X |
| 3,208,613 | 9/1965 | Brainard | 15/304 X |
| 3,983,597 | 10/1976 | Neumann | 15/304 |
| 4,325,161 | 4/1982 | Wood et al. | 15/304 |

*Primary Examiner*—Chris K. Moore

*Attorney, Agent, or Firm*—Cullen, Sloman, Cantor, Grauer, Scott and Rutherford

[57] ABSTRACT

A machine for automatically blowing debris, such as sand, out of cavities within engine block and similar type castings which have side openings connected to end openings to form internal cavities. The machine has a ferris-wheel-like frame arranged to rotate around a horizontal axis. The frame is divided into a number of horizontally opening compartments, each arranged to receive and hold a single casting. A dirty casting is loaded, horizontally endwise, while the frame is momentarily stationary, into the compartment which is then located in the lowermost position. Thereafter, the frame is rotated until the next compartment is located in the lowermost position, at which point the rotation is stopped so that the clean casting in the now lowermost compartment is horizontally removed endwise and is replaced with the next dirty casting. The stop, followed by the rotation, sequence is repeated so that each casting, within each compartment, is indexably rotated around the axis. During the time that the frame and castings are rotating, high pressure air blowing nozzles, which are located in each compartment, automatically swing into the openings located on the sides of the castings to blow the debris contained therein. The high pressure air blower nozzles swing out of the side openings during the time that the frame rotation is momentarily stopped during the unloading the loading of the castings in the lowermost compartment. During that time low pressure air nozzles, which are fixedly positioned along side of each compartment, except for the lowermost one, direct low pressure air into the openings in the ends of the castings. Thus, the cavities within the castings are repeatedly subjected to alternating high pressure air blasts in one direction and low pressure air blasts in the opposite direction for loosening and blowing sand and the like debris out of the casting cavities.

7 Claims, 6 Drawing Figures

MACHINE FOR CLEANING CASTINGS

BACKGROUND OF INVENTION

In foundry casting metal parts in sand molds, it is necessary to clean sand and other debris off the casting after the metal solidifies and is broken out of the sand mold in which it is formed. This is commonly done using compressed air nozzles against the external and internal surfaces of the casting along with such brushing or impacting as may be need to loosen the sand and other debris.

In certain types of foundry casting operations, particularly in the automotive industry, castings are made in mass production at a high rate of speed which makes it difficult to clean the castings fast enough to keep up with the production rate. This is particularly true in the casting of engine blocks, heads and similar types of castings which have internal cavities which communicate through openings to the outside surfaces of the castings. For example, in engine blocks, the internal cylinders and the like cavities communicate through openings in the ends of the casting as well as openings through the side walls of the casting. In these types of castings, it is somewhat difficult to clean off sand and other debris which sticks to them following their removal from the sand casting molds which are used to produce them. Thus, there is a need for a rapid, automatic system for cleaning the internal cavities within such type of castings with minimum labor and equipment.

The invention herein relates to a machine which will automatically clean off, that is, blow-out, the debris from within the internal cavities of castings such as engine blocks, at a high rate of speed, without the need for separate labor for handling or cleaning.

SUMMARY OF INVENTION

The invention contemplates a ferris-wheel type of frame having compartments which rotate around a horizontal axis, like a ferris-wheel, to carry castings round a central, horizontal axis. The ferris-wheel is indexed to stop and then to rotate a short distance and to repeat this indexing cycle so that one of the compartments, i.e., the lowermost one serves as an unloading and loading station. The remaining compartments each hold a casting which rotatably advances on the stop and rotational movement cycle 360° from the lowermost station around the circumference of the ferris-wheel movement and back to the lowermost station for unloading.

Moveable high pressure air nozzles are located within each of the compartments and are arranged to enter into the side openings in the casting which is then located in that compartment during the times that the ferris-wheel frame is rotating. However, when the ferris-wheel frame is stationary for the momentary step of unloading and reloading the lowermost compartment, the moveable nozzles are swung away from their respective casting's side openings. Instead, during that time, fixed nozzles located adjacent each of the compartments are in alignment with the end openings in the castings and these blow pressurized air through the end openings, into the cavities of the castings.

By alternating the blowing of compressed air, first, through the side openings in the castings by the moveable nozzles and thereafter, by the fixed nozzles through the end openings in the castings, the pressurized air flow through the castings is repeatedly reversed a number of times while the casting traverses the 360° path from its loading to unloading step. This loosens and blows out of the casting cavities the accumulated debris, that is, the sand and other foundry debris that accumulates within casting cavities in said casting operations or in other casting types of systems in which debris tends to accumulate on and within the castings.

One object of this invention is to provide apparatus which is automatic and requires no hand labor during normal operation and which is fast in cycling through the cleaning steps. Thus, the equipment can be placed within an automatic production line which receives castings on an entry conveyor, cleans the castings, and moves the castings on a removal conveyor to the next operating station in the line.

Another object of this invention is to provide a machine which will alternatively blow compressed air, in repeated and numerous cycles, first in one direction through a casting and then in the opposite direction through a casting for loosening and blowing out accumulated debris. The machine is made so that it is open and therefore, the blown out debris blows out of and around the machine, which can be contained within a separate room that can be cleaned by a suitable debris removal blower system.

These and other objects and advantages of this invention will become apparent upon reading the following description, of which the attached drawings form a part.

DETAILED DESCRIPTION

Figure 1:
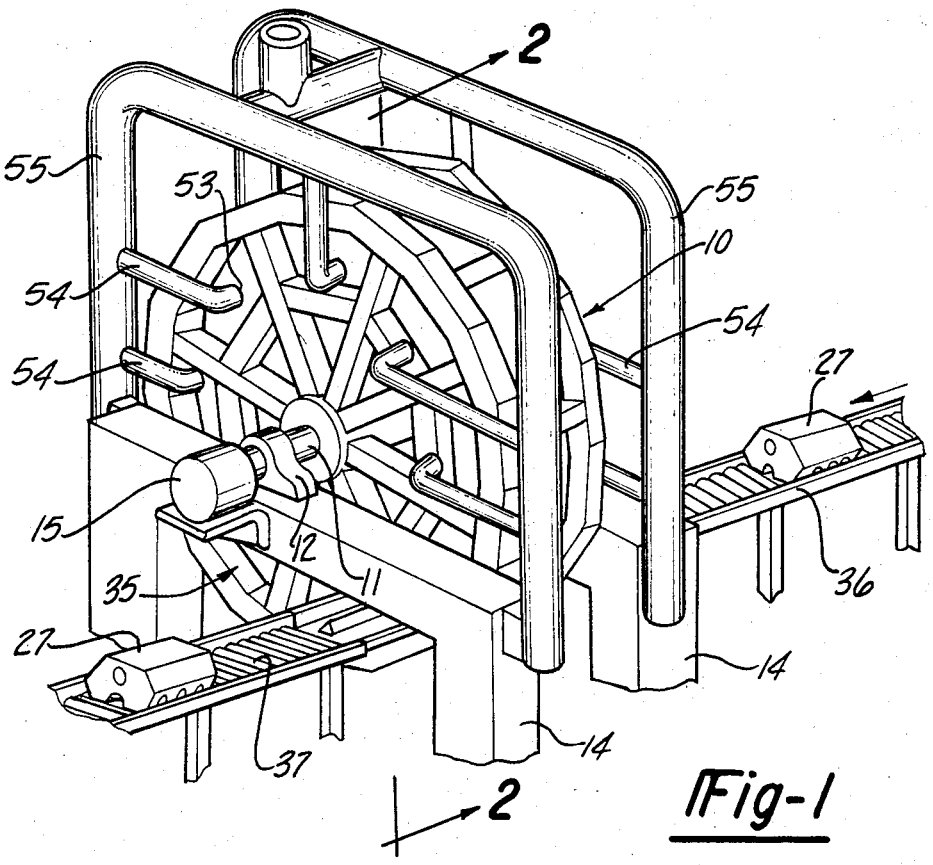
FIG. 1 is a perspective view of the machine.
Figure 2:
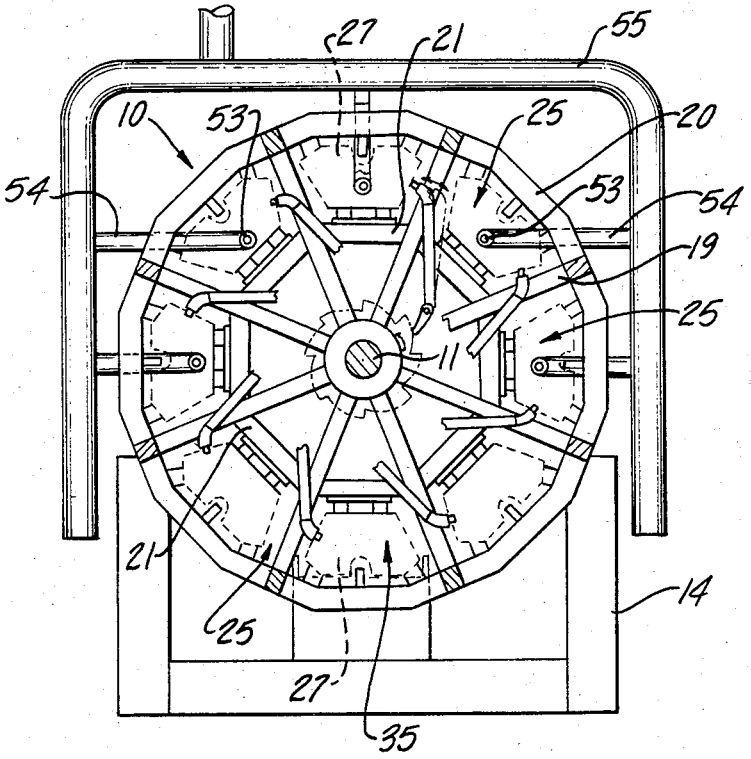
FIG. 2 is a front elevational view taken in the direction of arrows 2—2 of FIG. 1.
Figure 3:
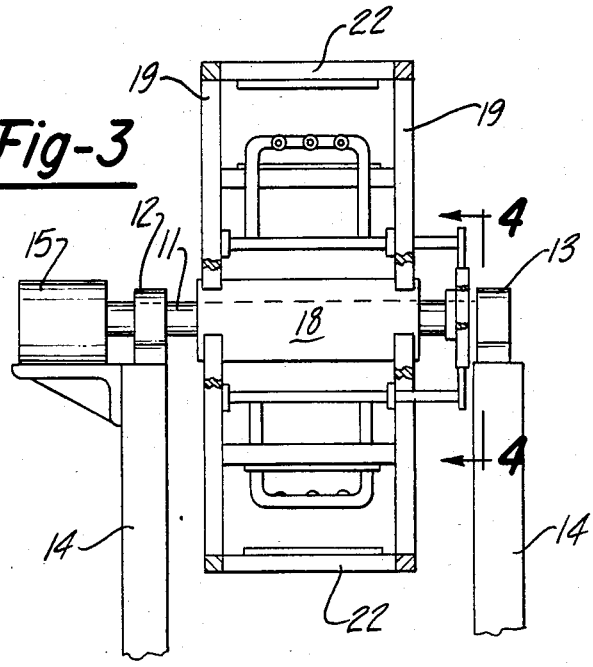
FIG. 3 is a partial cross-sectional, side elevational view of the machine.

Referring to FIGS. 1 and 2, the machine includes a rotatable frame 10 shaped somewhat like a ferris-wheel. The frame is mounted upon a horizontally arranged axle 11 supported in heavy bearings 12 and 13 (See FIG. 3) which are mounted upon opposed rectangular support frames 14. The ferris-wheel frame is rotated by a motor 15 (see FIG. 3).

The ferris-wheel frame is shown schematically in the drawings, with the understanding that its detailed construction requires sufficient bracing and reinforcing struts and the like to provide a rigid frame which is capable of supporting the substantial weights of the castings involved. Those skilled in the arts can suitably construct the ferris-wheel frame to support the required weights, depending upon the size of the castings.

The ferris-wheel frame is formed with a central hub 18 which receives the axle 11. Spokes 19 radiate outwardly from the hub and connect with outer rings 20. Suitable inner cross-members 21 extend between and connect with the spokes inwardly of the outer circumference. Likewise, suitable outer cross-members 22 brace and interconnect the outer rings. The cross-members, as illustrated in FIG. 6, together with the spokes, define circumferentially spaced apart compartments 25.

Each of the compartments is of a size and shape to receive a casting 27 which substantially fills each of the compartments. The construction shown in the drawings illustrate eight compartments. Thus, each compartment receives a casting, as will be described below.

For the purposes of positioning the casting properly within its respective compartment, inner guide and support blocks 28 are secured on the inner cross-members. Likewise, outer support and guide blocks 29 are positioned on the outer rings 20. In addition, guide strips 30 secured to the outer rings serve to position and guide the castings within their compartments.

Figure 6:
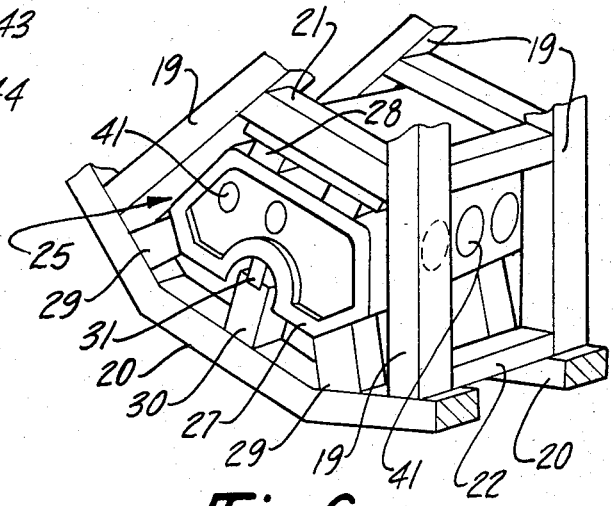
FIG. 6 is an enlarged, fragmentary view of the ferris-wheel frame showing one compartment with a casting located therein.

The guide strips may also be provided with clamps, such as the schematically shown movable piston clamps 31 illustrated in FIG. 6. These can be hydraulically or pneumatically operated. Other suitable clamp mechanisms can be provided to hold the castings firmly within their respective compartments.

As mentioned, eight compartments are illustrated. The lowermost compartment position is the unload and load position. Here, the clean castings are removed horizontally endwise, and the dirty castings are similarly loaded. In order to move the castings into and out of the lowermost compartment 35, a suitable inlet conveyor 36 directs the castings endwise into the compartments while an outlet conveyor 37 receives the clean castings removed from the lower compartment. For purposes of illustration, typical roller conveyors are illustrated for this purpose.

The machine is particularly useful in cleaning automotive type engine blocks which are formed by casting. These castings typically have side openings 40 and end openings 41 which communicate with cavities located within the castings. The purpose of the machine is to remove the sand, and other debris and metal fragments located within the interior cavities. For that purpose, high pressure air nozzles (see FIG. 5) are formed to extend into or to be aimed into the casting side openings 40 to direct high pressure air into the openings, through the internal cavities and out of the end openings of the castings.

Figure 4:
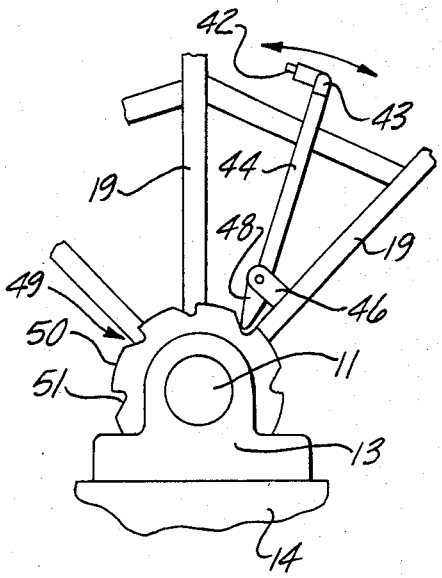
FIG. 4 is an enlarged, fragmentary view of the cam and follower mechanism for operating the high pressure nozzles.
Figure 5:
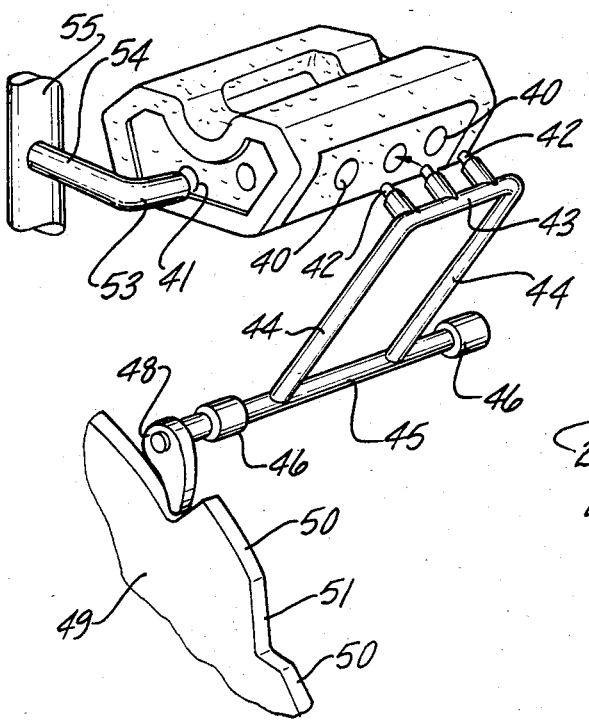
FIG. 5 is an enlarged, perspective view of one of the high pressure nozzle mechanisms and a low pressure nozzle positioned relative to a casting.

The high pressure air nozzles, as illustrated schematically in FIGS. 4 and 5, are mounted upon a support tube 43 which, in turn, is connected to lever tubes 44 opening into and connect to an axle tube 45 which rotatably extends through bearings 46 that are mounted upon the spokes or other adjacent portions of the ferris-wheel frame.

A cam follower 48 fixedly secured to the outer end of the axle tube 45 engages a cam 49 which is immoveably secured to the rectangular support frame 14 at its bearing 13. The cam is provided with lobes 50 and valleys or depressions 51. Thus, as the ferris-wheel frame rotates, the cam follower slides along the surface of the cam and successively engages the lobes 50 and the valleys 51. Each time the cam follower engages a lobe, it pivots the axle tube 45, lever tube 44 and support tube 43 so as to engage the high pressure nozzles 42 with the side openings in the castings. This blows the high pressure air into the casting in one direction.

The valleys or depressions 51 in the cam are so located as to correspond with the times that the ferris-wheel frame is stationary. The stationary position occurs each time a clean casting is removed from and a dirty casting is replaced in the lowermost compartment 35. Thus, there is a repeated cycle of indexing or indexable rotation of the ferris-wheel frame wherein it stops for loading and unloading, during which time the follower engages the cam valley, and then frame rotates until the next successive compartment is in alignment with the lowermost compartment. During that rotation the follower engages the cam lobe. Each compartment, has a follower and nozzle arrangement, but the cam lobe is omitted for the lowermost position so that the nozzles do not swing into the casting holes during the times that a casting is unloaded and another casting is loaded.

When the frame is stationary, fixed, low pressure nozzles 53 are aimed into the end openings in the castings. These nozzles are located on opposite sides of the frame and are connected to air supply tubes 54 which in turn communicate with U-shaped frame tubes 55 that carry low pressure air. These nozzles continuously blow pressurized air towards the ends of the castings. When the casting end openings are aligned with the low pressure nozzles, which occurs each time the ferris-wheel frame is stationary, low pressure air is blown into the end openings of all of the castings except at the lowermost station, where the low pressure nozzles are omitted. The air passes through the cavities and out the side openings. In this manner, air is blown in a reverse direction through the castings, i.e. out of the side openings which are unblocked due to the high pressure nozzles having been pivoted out of the way for the stationary part of the ferris-wheel cycle.

The successive blowing of high pressure, low volume air in one direction and low pressure, high volume air in the opposite direction tends to loosen and blow away the debris, shot sand, etc. within the castings. This unwanted material blows around the machine and into the room containing the machine. Thus, the machine is typically located within a special room with a suitable blower system to evacuate and filter the dirty air from the room. As can be seen, the machine operates automatically so that no one need be in the room containing the machine during the time that the debris is blown out of the castings.

Each casting is treated with pressurized air (in two directions) seven times in the cycle. The pressure of the air is selected based upon the type of casting, type and amount of debris, etc. Thus, a suitable compressed air supply system of some conventional type is used for this purpose.

The operation can be very rapid, processing on the order of several hundred or more castings per hour automatically, untended and without the need to manually cleanup the area to remove the debris blown from the castings.

Having fully described an operative embodiment of this invention we now claim:

1. A machine for cleaning debris, such as sand out of castings which have side openings internally connected to end openings, such as engine block castings and the like comprising:

a ferris-wheel-like frame mounted for rotation upon a horizonal axle and have a number of circumferentially separated, casting receiving compartments which open horizontally, that is parallel to the axle;

means for horizontally loading and unloading a casting into the compartment loaded in the lowermost position while the frame is momentarily stationary;

said frame being indexably rotatable after each lowermost compartment is loaded with a casting, to locate each next succeeding compartment in the lowermost position for unloading and loading castings so that the castings rotate, within their respective compartments, around the axle from the lowermost position of the compartment 360° back to the lowermost position;

moveable nozzles mounted in each compartment arranged to enter the side openings of the casting in such compartment;

and means for moving and holding the nozzles in said openings during the times that the frame is rotating and for moving the nozzles out of the openings in the castings when the frame is momentarily stationary, i.e. during the times that the lowermost compartment is unloaded and loaded;

stationary nozzles mounted adjacent the frame, along side of the compartments, and located so that they aim into the end openings in the castings at each compartment, except for the lowermost one during the time the frame is stationary;

and all of said nozzles carrying pressurized air for blowing into their respective side and end openings and into the cavities within the casting which connect such openings for blowing debris out of the casing.

2. A machine as defined in claim 1, and said movable nozzles carrying high pressure air and said stationary nozzles carrying lower pressure air for alternately flowing high pressure air in one direction and low pressure air in the opposite direction through the castings while the castings are rotating and stopped, respectively.

3. A machine as defined in claim 1, and said means for moving and holding the moveable nozzles comprising a multi-lobe cam non-moveably mounted at the frame axle, and having a lobe operatively corresponding to each compartment except for the one located in the lowermost position at any particular time;

and each compartment having a cam follower engaging the cam, with each cam follower pivoting a lever member which is pivotally connected in its respective compartment and which carries a nozzle support so that the nozzles on the nozzle support move towards the respective casting due to the cam lobe engaging the follower during the that the frame is rotating and the nozzle move away from the respective casting side openings due to the followers disengaging from the cam lobes during the time that the frame is stationary.

4. A machine as defined in claim 3, and said stationary nozzles being mounted upon a non-moveable support adjacent one side of the frame and normally blowing low pressure air at all times, regardless as to whether the frame is stationary or rotatably moving and positioned so that the stationary nozzles are automatically in alignment with the casting end openings during the times that rotation is stopped.

5. A machine as defined in claim 3 and including a second set of stationary nozzles, similar to the first mentioned set of stationary nozzles in construction and operation, but located at the opposite side of the frame for blowing low pressure air into openings in the opposite ends of the castings during the times that the rotation is stopped.

6. A machine for cleaning debris, such as sand, out of castings which have internal cavities which open into the surfaces of the casting in at least two separate places, comprising:

a ferris-wheel-like frame mounted upon a horizontal axle for rotation and having a substantial number of separate, casting receiving compartments circumferentially formed upon the frame;

the frame being rotatable in a stop and rotate, indexable cycle, with one of the compartment locations during the stop portion of the cycle being an unload-reload station in which a clean casting is removed from that compartment and is replaced with a dirty casting;

nozzles, carrying pressurized air, mounted within each compartment for blowing pressurized air into selected ones of the openings in the castings during one part of the stop-rotating cycle;

separate nozzles located to blow pressurized air into other of the openings in the castings during the other part of the stop-rotating portion of the cycle;

whereby pressurized air flows in one direction through each casting, except for the casting then at the unloading-reloading station, during part of the indexing cycle while pressure air is flowed in the opposite direction through the same castings during the remaining part of the indexing cycle for thereby loosening and blowing debris out of the cavities within the casting.

7. A machine as defined in claim 6, and wherein one of the sets of nozzles are moveably mounted with means for moving them to the openings in the casting into which they blow and then moving them away from the respective casting openings during the times that the other set of nozzles are closely aligned with and blow into their respective casting openings, so that during the indexing cycle of movement of the castings one set of openings receive pressurized air while their opposite openings are exposed for blowing out the air and then the blowing of air into and out of the castings is reversed.

* * * * *

UNITED STATES PATENT AND TRADEMARK OFFICE

CERTIFICATE OF CORRECTION

PATENT NO. : 4,639,968

DATED : February 3, 1987

INVENTOR(S) : Kenneth D. McKibben, Alan P. Gould, Craig J. Groh; Thomas E. Wuepper It is certified that error appears in the above-identified patent and that said Letters Patent is hereby corrected as shown below:

In claim 1, line 10, delete "loaded" and add --located-- and in line 38, delete "casing" and add --casting--.

Signed and Sealed this

Tenth Day of November, 1987

*Attest:*

DONALD J. QUIGG

*Attesting Officer*

*Commissioner of Patents and Trademarks*